United States Patent [19]

Danberg

[11] 4,131,247

[45] Dec. 26, 1978

[54] APPARATUS FOR REDUCING FRAGMENTARY STOCK

[76] Inventor: Victor Danberg, 6 Mary Ann Ln., Wallingford, Conn. 06492

[21] Appl. No.: 827,885

[22] Filed: Aug. 26, 1977

Related U.S. Application Data

[63] Continuation-in-part of Ser. No. 712,656, Aug. 9, 1976, abandoned.

[51] Int. Cl.[2] ..... B02C 23/38

[52] U.S. Cl. ..... 241/49; 241/56; 241/73

[58] Field of Search ..... 241/49, 50, 56, 57, 241/58, 73, 222, 224

[56] References Cited

U.S. PATENT DOCUMENTS

| | | | |
|---|---|---|---|
| 577,278 | 2/1897 | Autenrieth | 241/73 |
| 1,568,520 | 1/1926 | Martens | 241/49 |
| 2,225,781 | 12/1940 | Hinerfeld | 241/49 |
| 2,886,331 | 5/1959 | Simpson | 241/222 |
| 3,285,692 | 11/1966 | Robertson | 241/56 |

*Primary Examiner*—Granville Y. Custer, Jr.
*Attorney, Agent, or Firm*—Walter Spruegel

[57] ABSTRACT

A cylindrical working chamber in stock reducing apparatus features opposite ends which are open to the atmosphere so that a fan in the chamber outlet draws atmospheric air into the chamber through the open ends thereof, thence through stock in a turning and centrifugally maintained annular stream on the peripheral chamber wall as it passes over a sizing screen at the chamber outlet, and finally through the screen and following chamber outlet.

2 Claims, 4 Drawing Figures

APPARATUS FOR REDUCING FRAGMENTARY STOCK

This application is a continuation-in-part of my copending application Ser. No. 712656, filed Aug. 9, 1976, now abandoned.

This invention relates to apparatus for reducing fragmentary materials in general, and to apparatus for reducing such materials by cutting in particular.

The type of apparatus of interest provides stationary and rotary companion cutting tools in the form of knife blades or even beating hammers as in conventional rotary cutters or in impact hammer mills, respectively, of which the rotary tools on a driven rotor in a working chamber of the apparatus cooperate with the stationary tools on the peripheral wall of this chamber in reducing fragmentary material, called "stock" for simplicity, which is introduced through an inlet in the peripheral chamber wall, by cutting it into smaller particles for their passage through a screen of given mesh size over an outlet in the peripheral chamber wall opposite to the chamber inlet, with the outlet being customarily provided with a fan for several purposes, one of which is to draw reduced particles through the screen and outlet and thus augment the usual gravity discharge of reduced particles from the stream through the screen and outlet. The cutting tools on the driven rotor also function to set and centrifugally maintain the introduced stock in rotary motion in the form of an annular stream on the peripheral chamber wall, with the stock in this stream being replenished by additionally introduced stock at the rate at which properly reduced particles are discharged from the stream through the screen and chamber outlet. Another purpose of the fan in the chamber outlet is to draw air from the atmosphere through the chamber inlet, then through the layers of the stock stream which at any instant pass over the chamber inlet and over the screen at the chamber outlet, respectively, and finally through the screen and chamber outlet, all to the end of aircooling the interior of the apparatus and especially the stock in the stream which are subjected to heat converted from the energy expended in reducing the stock and from operational friction between relatively moving stock fragments in the stream and also between the stream and chamber walls. To maintain the interior of the apparatus and the moving stock stream cooled in this fashion, it is customary to seal the working chamber, including the opposite ends thereof, from the atmosphere, except at the chamber inlet, so that the fan in the chamber outlet will draw air from the atmosphere into the chamber inlet and no other place of the apparatus; and to compel the drawn air in the chamber inlet to pass through layers of the stock stream, as mentioned, and not around the stream, the cutting tools are extended over the entire length of the working chamber so that the stock stream extends widthwise also over the entire length of this chamber and leaves no gaps at the chamber ends through which the air could bypass around the stock stream.

While prior apparatus of this type are entirely satisfactory for reducing stock of certain characteristics, they are much less satisfactory, and even unsuitable, for reducing stock of certain other characteristics, with the kind of performance of these apparatus, i.e., satisfactory or less than satisfactory, depending largely on the sufficiency or insufficiency of air-cooling in the aforementioned fashion stock in the process of cutting. Thus, if the stock is, for example, rather brittle or friable and has low heat retentivity, these being among characteristics of kinds of stock which lend themselves more readily to grinding, such as sugar or coal, for instance, such stock will fracture and break up into the required smaller particles fairly quickly and easily and require comparatively little energy for the reduction, whereby such heat-up of the stock as will occur will be negligible or at the most quite tolerable, especially since the mass of such stock in the stream is more often than not rather porous and, hence, effectively cooled by the air drawn through the apparatus by the fan in the chamber outlet. On the other hand, if the stock is, for example, fairly soft or flexible and has high heat retentivity, these being among characteristics of kinds of stock which are more difficult to grind, such as certain plastics, rubber or synthetic fibers, for instance, operational fracture and break-up of such stock into the required smaller particles will require a longer cutting period and the expenditure of more energy for the reduction, with the result that the interior of the apparatus, including the stock therein, heats up not only rather rapidly, but also to a fairly high temperature at which the stock is often beyond effective cooling by the air drawn into the apparatus by the fan in the chamber outlet. Evidently, the longer it takes, and the more energy is expended, in reducing such stock into smaller particles, the greater will be the build-up of heat not only in the stock stream, but also in the interior working chamber of the apparatus, and whatever atmospheric air is drawn into the apparatus by the fan in the chamber outlet will soon lose cooling control over this vast and ever-increasing heat build-up in the apparatus. Further, such stock will more often than not settle in the moving stream into a rather dense mass of little porosity, thereby severely impeding, if not blocking, air draft through the apparatus by the operating fan in the chamber outlet and, hence, further contributing to rapid and excessive heat-up of such stock. Rapid and excessive heat-up of such stock from these and still other causes often assumes proportions where the stock being cut ignites and starts a fire with ensuing material losses and also hazards, with a fire breaking out often only minutes after starting a cutting operation. To avoid such fires, recourse is had at times to freezing materials which are mixed with the stock to keep its temperature below the ignition point during cutting. However, this is hardly an acceptable remedy for adapting apparatus of this type to reducing such difficult-to-reduce stock, because it entails a rather high and mostly prohibitive cost.

It is among the objects of the present invention to provide apparatus of this type which lends itself to entirely satisfactory reduction of stock, including stock which heretofore was most difficult to reduce, without giving rise to any fire or even only undue operational heat build-up in the apparatus, by opening to the atmosphere the very interior of the apparatus, i.e., the working chamber inside the moving annular stock stream therein, which in prior apparatus of this type was so deliberately sealed from the atmosphere except for reach by atmospheric air through the chamber inlet and the relatively dense layer of the stock stream which passes over the chamber inlet at any instant. With this arrangement, the operating fan in the chamber outlet constantly draws a fairly large amount of air from the atmosphere, not at all into the chamber inlet as heretofore, but rather into the large space in the working chamber inside the annular stock stream therein, whereby this large interior space in the apparatus is little subjected to the heat in the moving stock stream and in the rest of the apparatus and, hence, is maintained at approximate atmospheric temperature, and all the air thus constantly drawn into this large space is by the operating fan further drawn with particular force through the layer of the moving stock stream which passes at any instant over the screen at the chamber outlet. The result of this is that the fairly cool air thus constantly flowing toward and into this stock layer at a relatively high volumetric flow rate is by the spinning rotor set into turbulence so as to act on the stock in the manner of a fluidized air bed wherein the stock fragments exhibit more or less noticeable turbulence at which they are subjected to optimum cooling by this air, and are also reoriented for apparently repeated cutting action by the tools.

It is another object of the present invention to provide apparatus of this type in which the interior of the working chamber inside the moving stock stream therein is opened to the atmosphere, as aforementioned, by simply providing the apparatus with central openings in the opposite endwalls of the working chamber, with the shaft of the rotor extending through these openings which are easily made sufficiently large to have adequate clearance from the passing shaft to admit therethrough fan-drawn air at the required rate. With this arrangement, the bearings for the rotor shaft may conveniently be provided on the outside of the working chamber at any desired spacing from the endwalls thereof at which they will not interfere with ready access of atmospheric air to the openings in these endwalls, and the rotor which carries the rotary cutting tools may be made quite condensed, sizewise, so as to take up a minimum of the interior space of the working chamber inside the stock stream and thereby make it all the more easy to maintain the interior chamber space at a preferred lowest temperature which approximates atmospheric temperature as closely as possible.

It is a further object of the present invention to provide apparatus of this type in which the volumetric flow rate of atmospheric air into the interior of the working chamber by operation of the fan in the chamber outlet is increased, by providing the rotor shaft at, including inside, the aforementioned central openings in the endwalls of the working chamber with fan blades which, on the drive of the rotor for operation of the cutting tools on stock, force additional air into the interior of the working chamber at no additional cost.

Further objects and advantageous will appear to those skilled in the art from the following, considered in conjunction with the accompanying drawings.

Figures 1, 2, 3, 4:
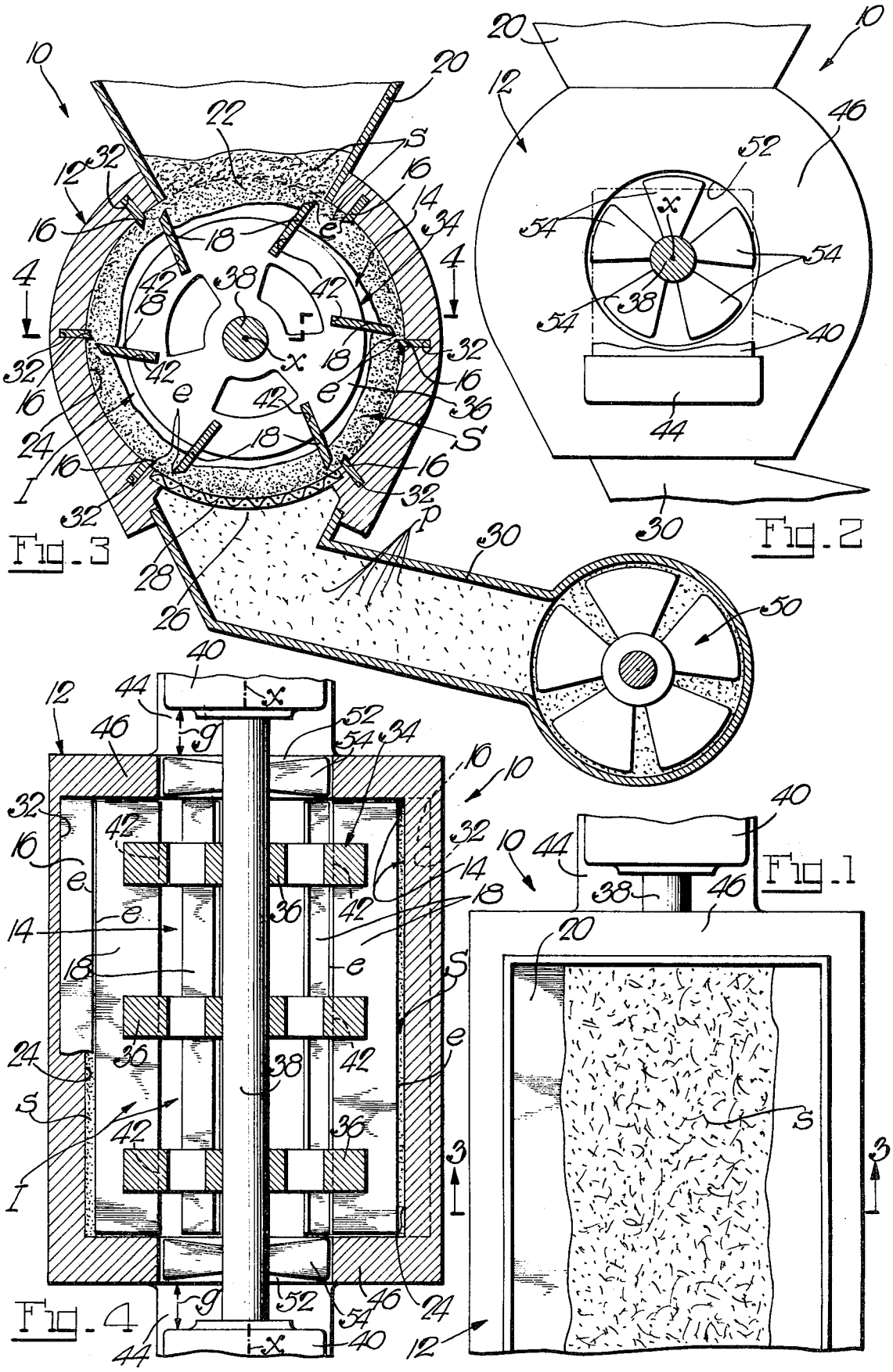
FIG. 1 is a fragmentary plan view of apparatus embodying the invention.
FIG. 2 is a fragmentary end view of the apparatus.

FIGS. 3 and 4 are sections through the apparatus taken substantially on the lines 3—3 and 4—4, respectively, of FIGS. 1 and 3.

Referring to the drawings, the reference numeral 10 designates stock cutting apparatus providing a housing 12 with a substantially cylindrical working chamber 14 in which stock *s* in the form of fragmentary material is reduced to smaller particles *p* by companion stationary and rotary tools 16 and 18, respectively, which in this instance are blades with cutting edges *e*. Stock *s* is introduced into the chamber 14 through a hopper 20 which leads to an inlet 22 in the peripheral wall 24 of the chamber, and properly reduced particles *p* are discharged from the chamber 14 through an outlet 26 with an interposed sizing screen 28 of given mesh size, and a continuing conduit 30 which leads to a collecting station (not shown).

The stationary cutting blades 16 are mounted in the peripheral chamber wall 24, in this instance in angularly spaced longitudinal grooves 32 therein, and the rotary cutting blades 18 are carried by the rotor 34 which in this instance provides a plurality of discs 36 on a shaft 38 the opposite ends of which are journalled in suitable bearings 40 for rotation of the shaft about the axis *x* of the cylinder chamber 14, with the cutting blades 18 being carried by the discs 36 by being in this instance mounted in angularly spaced peripheral grooves 42 therein. The bearings 40 are in this instance mounted on platforms 44 on the endwalls 46 of the chamber 14. A suitable power drive (not shown) is provided for operational drive of the rotor 34 in clockwise direction (FIG. 3) for cutting cooperation between the stationary and rotary blades 16 and 18 in reducing stock *s* into smaller particles *p*, with the rotor 34 being driven at a speed at which the blades 18 maintain the stock *s* by centrifugal force in the form of an annular stream S on the peripheral chamber wall 24. As a further result of this applied centrifugal force, and further by the action of the cutting blades 16, 18 on the stock *s*, the stock fragments in the stream *s* are set into relative motion and the stock stream *s* as such is also maintained in rotary motion in clockwise direction (FIG. 3) and thus passes constantly over the sizing screen 28 at the chamber outlet 26 for the discharge therethrough of sufficiently reduced stock particles *p*. For an important purpose described hereinafter, and also to expedite the discharge of properly reduced stock particles *p* from the moving stock stream S through the screen 28, there is interposed in the conduit 30 a power-operated fan 50 which draws stock particles from the stream S into and through the screen 28 and through the following conduit 30 to the beforementioned collecting station.

In reducing fragmentary stock *s* in this fashion into particles *p* of a size determined by the screen 28, the energy expended in reducing the stock, plus such operational friction as will take place between the relatively moving stock particles in the stream *s* and also between the moving stream S and the stationary structure of the apparatus, will be converted into heat which manifests itself in the stock and also in the apparatus. As pointed out earlier, stock of various kinds which lend themselves more readily to cutting, such as coal or sugar, for example, will in the process of cutting undergo negligible, and at the most entirely tolerable, heat-up which in any event is readily controlled by such cooling of the stock as is afforded by the atmospheric air which is drawn into the interior of the apparatus by the operating fan 50 in the outlet conduit 30, so that the apparatus may perform uninterruptedly for most any length of time in cutting such stock into smaller particles without any excessive heat-up of the stock or apparatus from overheating. However, and as also pointed out earlier, other kinds of stock which are much more difficult to cut, such as certain plastics, rubber or synthetic fibers, for example, often require a longer period of time, and also more energy, in order to be cut into properly reduced particles, so that the ensuing heat-up of the stock and apparatus takes place rather rapidly, and often rises beyond effective cooling by whatever atmospheric air will be drawn into the interior of the chamber customarily through the chamber inlet as in prior apparatus of this type, with the result that a fire is started in the apparatus sooner or later and often in a matter of minutes only after starting a cutting operation.

In order to avoid any excessive operational heat-up of stock of any kind, including most difficult-to-cut stock which inevitably overheated and caused a fire in prior apparatus of this type, and to avoid a fire in the apparatus in any event, the stock being cut is cooled entirely adequately to these ends by atmospheric air which is drawn into and through the interior of the apparatus in a featured path of the invention. This featured path starts into the apparatus at the opposite ends of the working chamber 14 which to this end are left open to the atmosphere by providing in this instance relatively large central openings 52 in the endwalls 46 of the chamber, with the path being continued from there by the interior I of the chamber 14 inside the annular stock stream S therein, then by the screen 28 and the stock stream S passing thereover at any instant during operation of the apparatus, then by the chamber outlet 26 and finally by the conduit 30 with the interposed fan 50 (FIG. 3). With the rotor 34 taking up only a fairly small part of the space in the interior of the chamber 14 inside the annular stock stream S, the interior chamber part I of this featured air path is quite voluminous and holds a correspondingly large volume of atmospheric air at any instant which, moreover, remains at approximate atmospheric temperature and is at most only negligibly higher than atmospheric temperature, especially since the openings 52 in the endwalls 46 of the chamber 14 are relatively large and also spaced by wide gaps *g* from the adjacent rotor bearings 40 and, hence, pose no impediment to the inflow of atmospheric air into the chamber interior I by the action of the fan 50 in the conduit 30. Thus, this fairly large and constantly replaced volume of atmospheric air will keep the chamber interior I at approximate atmospheric temperature. The atmospheric air in the chamber interior I even prevents appreciable heat-up of the rotor 34, for the cutting blades 18 on the rotor, which will undergo some operational heat-up in cutting action, are during the power drive of the rotor in particularly effective heat-exchange with the surrounding air which keeps the heat-up of these cutting blades at an entirely tolerable level without a noticeable rise in the temperature of the large air mass in the chamber interior. Therefore, the air being drawn by the operating fan 50 from the chamber interior I through the screen 28 at the chamber outlet 26 and through the annular stock stream which passes over the screen at any instant, is not only fairly cool but has also a relatively high volumetric flow rate, and for these reasons acts on the stock in the manner of a fluidized air bed wherein the stock fragments exhibit more or less noticeable turbulence at which they are subjected to optimum cooling by this air, and are also reoriented for apparently repeated cutting action by the companion blades 16, 18. Apparatus provided with this featured path for fan-drawn atmospheric air have without exception proved to be highly practical and successful in reducing all kinds of stock which heretofore was particularly difficult to reduce, and could not be reduced on a commercial scale, in prior apparatus of this type because of fires which inevitably broke out in these apparatus often only minutes after starting an operation. Thus, apparatus with this featured path for fan-drawn atmospheric air have repeatedly been operated continuously for a full day's shift in reducing such difficult-to-cut stock as rubber, for example, without experiencing any undue operational heat-up of these apparatus or of the stock being cut, and much less any fire in the apparatus.

In leading the rotor shaft 38 through the central openings 52 in the endwalls 46 of the working chamber 14 for its journal support in the external bearings 40, fan blades 54 may be mounted on the shaft 38 in the vicinity of, and preferably within, the central openings 52 in the chamber endwalls 46 to force additional atmospheric air into the chamber interior I on the power drive of the rotor 34 if such additional atmospheric air is desired for any reason.

What is claimed is:

1. Apparatus for reducing fragmentary stock into smaller particles, comprising a chamber with an axis having a peripheral wall about said axis and opposite endwalls, and stock inlet and outlet passages leading to and from said peripheral wall; a sizing screen in said chamber in cover relation with said outlet passage; a rotor in said chamber having a hub mounted for rotation about said axis and being inwardly spaced from said peripheral wall by an annular gap, and angularly spaced cutting tools on and turning with said hub and projecting outwardly therefrom into said gap, with said cutting tools being blades having turning cutting edges and being disposed in a ring-shaped path about said axis; stationary cutting tools on said peripheral wall, said turning tools acting to centrifugally force stock in said chamber into an annular formation and to propel the same in the form of a stream on said peripheral wall, with said stationary and turning cutting tools cooperating to cut said stock into particles for passage through said screen; and fan means in said chamber outlet, with each of said endwalls having within the cylindrical confines of said path an opening through which said gap is exposed to the atmosphere so that on operation of said fan means the ensuing draft of atmospheric air enters said chamber through said openings into said gap, and passes through the stock stream and then through said screen and chamber outlet, with said turning cutting tools agitating the air drawn by said fan means into said gap through said openings and thereby keeping the stock in said stream in a turbulent condition.

2. Apparatus as in claim 1, in which said rotor has a center shaft extending through said openings with clearance therefrom, and there are further provided fan blades on said shaft and within said openings.

* * * * *